US008636539B2

(12) United States Patent
Kobayashi et al.

(10) Patent No.: US 8,636,539 B2
(45) Date of Patent: Jan. 28, 2014

(54) CONNECTOR

(75) Inventors: Kotaro Kobayashi, Kanagawa (JP); Toshiya Oda, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 139 days.

(21) Appl. No.: 13/416,124

(22) Filed: Mar. 9, 2012

(65) Prior Publication Data

US 2012/0231660 A1 Sep. 13, 2012

(30) Foreign Application Priority Data

Mar. 9, 2011 (JP) ..... 2011-052210

(51) Int. Cl.
*H01R 13/10* (2006.01)

(52) U.S. Cl.
USPC ..... 439/424

(58) Field of Classification Search
USPC ..... 439/424, 421, 877
See application file for complete search history.

(56) References Cited

U.S. PATENT DOCUMENTS

| | | | | | |
|---|---|---|---|---|---|
| 2,600,012 | A | * | 6/1952 | Macy | 439/877 |
| 3,612,747 | A | * | 10/1971 | Shlesinger, Jr. | 174/84 C |
| 3,728,473 | A | * | 4/1973 | Kuo | 174/84 C |
| 3,912,853 | A | * | 10/1975 | Wilkes | 174/84 C |
| 4,191,442 | A | * | 3/1980 | Caveney et al. | 439/400 |
| 5,125,851 | A | * | 6/1992 | Peterson et al. | 439/421 |
| 5,658,163 | A | * | 8/1997 | DeRoss | 439/424 |

FOREIGN PATENT DOCUMENTS

JP 06-040499 2/1994

* cited by examiner

*Primary Examiner* — Gary Paumen
(74) *Attorney, Agent, or Firm* — Timothy M. Morella

(57) ABSTRACT

In a connector according to the Present Disclosure, a cable inserted into an insertion hole is inserted into a through-hole of a metal fitting contained in a support groove. The metal fitting contained in the support groove plastically deforms such that the size of the through-hole decreases when it is compressed in the depth direction of the support groove.

10 Claims, 12 Drawing Sheets

CONNECTOR

REFERENCE TO RELATED APPLICATIONS

The Present Disclosure claims priority to prior-filed Japanese Patent Application No. 2011-052210, entitled "Connector," filed on 9 Mar. 2012 with the Japanese Patent Office. The content of the aforementioned patent application is fully incorporated in its entirety herein.

BACKGROUND OF THE PRESENT DISCLOSURE

The Present Disclosure relates, generally, to a connector, and, more particularly, to a structure for fixing a cable to a case.

Japanese Patent Application No. H06-040499 discloses a technology for crimping the tip end of a cable with a metal fitting and then fixing the metal fitting in a case. More specifically, the tip end of a cable is first inserted into the through-hole of a metal fitting, after which the tip end is crimped with the metal fitting. Finally, the tip end of the cable, equipped with the metal fitting, is inserted into a case in order to mount the metal fitting on the case.

However, work is complicated in the above-mentioned Application because the process of insertion and fixing needs to be repeated before fixing a cable to a case.

SUMMARY OF THE PRESENT DISCLOSURE

The Present Disclosure will overcome the above-mentioned disadvantages. A purpose of the Present Disclosure, therefore, is to provide a connector capable of facilitating work for fixing a cable to a case.

In order to solve the above-mentioned problem, a connector according to the Present Disclosure is provided with a metal fitting on which a through-hole is formed as well as a case. In the above-mentioned case, a support groove for containing the metal fitting and an insertion hole for inserting a cable are formed. The support groove restricts the displacement of the metal fitting at least in the extending direction of the through-hole. The insertion hole is continuous to the support groove. A cable inserted into the insertion hole is inserted into the through-hole of the metal fitting contained in the support groove. The metal fitting contained in the support groove elastically deforms such that the size of the through-hole decreases when it is compressed in the depth direction of the support groove. Work is simple in the Present Disclosure as compared with the above-mentioned Application, because a cable can be fixed in a case simply by placing a metal fitting in a support groove, inserting a cable into an insertion hole and then compressing the metal fitting contained in the support groove.

In one aspect of the Present Disclosure, the metal fitting has a compression part protruding in the direction away from the through-hole, which is the direction opposite to the depth direction of the support groove. This method enables to decrease the size of the through-hole mainly by deforming the compression part. In this aspect, the compression part may have an incisor tooth part formed in such a manner that the edge of the through-hole protrudes in the depth direction of the support groove and comes into contact with the cable. This method enables to fix a cable by sandwiching it between the incisor tooth part provided for the compression part and a portion facing the incisor tooth part. Furthermore, a receiving part having a curved shape along the outward form of the cable may be formed at a portion facing the incisor tooth part on the edge of the through-hole. This method makes it difficult to decentralize pressure applied to the cable from the incisor tooth part. In this aspect, the metal fitting may have protrusions protruding in the direction opposite to the depth direction of the support groove on both sides of the compression part in the width direction of the support groove. In this method, the protrusions can be used to contain the metal fitting in the support groove.

In another aspect of the Present Disclosure, the metal fitting is a terminal composed of bent metal plates and may have a first plate part and a second plate part. The first plate part has the compression part, and the through-hole is formed thereon. The second plate part has a contact part for contacting the other terminal, and the through-hole is formed thereon. The first plate part and the second plate part are piled on each other such that the through-holes become continuous. This method enables to prevent the influence of the deformation of the compression part from exerting on the contact with the contact part because the compression part and the contact part are provided on different plate parts.

In another aspect of the Present Disclosure, the metal fitting is a metal fitting that is brought into contact with the insulating outer coat of the cable. This method enables to fix a cable to a case by means of a metal fitting while maintaining the insulation of the cable. In a final aspect of the Present Disclosure, the compression part has an incision tooth part formed in such a manner that the edge of the through-hole is protruded in the depth direction of the support groove, and the incision tooth part cuts the insulating outer coat of the cable and comes into contact with metal wires inside when the compression part is compressed in the depth direction of the support groove.

A connector according to the Present Disclosure is thus provided with a first metal fitting on which a through-hole is formed, a second metal fitting on which a through-hole is formed, and a case. The case is composed of a first support groove for containing the first metal fitting, a second support groove for containing the second metal fitting and an insertion hole into which a cable is inserted. The first support groove restricts the displacement of the first metal fitting at least in the extending direction of the through-hole. The second support groove restricts the displacement of the second metal fitting at least in the extending direction of the through-hole. The insertion hole is continuous to the first support groove and the second support groove. A cable inserted into the insertion hole is sequentially inserted into the through-hole of the first metal fitting contained in the first support groove and the through-hole of the second metal fitting contained in the second support groove. The first metal fitting contained in the first support groove plastically deforms such that the size of the through-hole decreases and comes into contact with the insulating outer coat of the cable when it is compressed in the depth direction of the first support groove. The second metal fitting contained in the second support groove plastically deforms such that the size of the through-hole decreases and comes into contact with metal wires exposed at the tip end of the cable when it is compressed in the depth direction of the first support groove.

Work is simple in the Present Disclosure as compared with the prior art because a cable can be fixed in a case simply by placing the first and second metal fittings in the first and second support grooves respectively, inserting a cable into an insertion hole and then compressing the first and second metal fittings. In this case, the second metal fitting can be used as a terminal.

The connector may further be provided with a third metal fitting on which a through-hole is formed, and a third support groove for containing the third metal fitting may further be formed in the case. The cable is coaxial. The third support groove is disposed between the first and second support grooves, is continuous to the insertion hole and restricts the displacement of the third metal fitting at least in the extending direction of the through-hole. The third metal fitting contained in the third support groove plastically deforms such that the size of the through-hole decreases when it is compressed in the depth direction of the third support groove and comes into contact with an outer conductor exposed between metal wires exposed at the tip end of the coaxial cable and the insulating outer coat. In this method, the third metal fitting can be used as a terminal that comes into contact with the outer conductor of the coaxial cable.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1A:
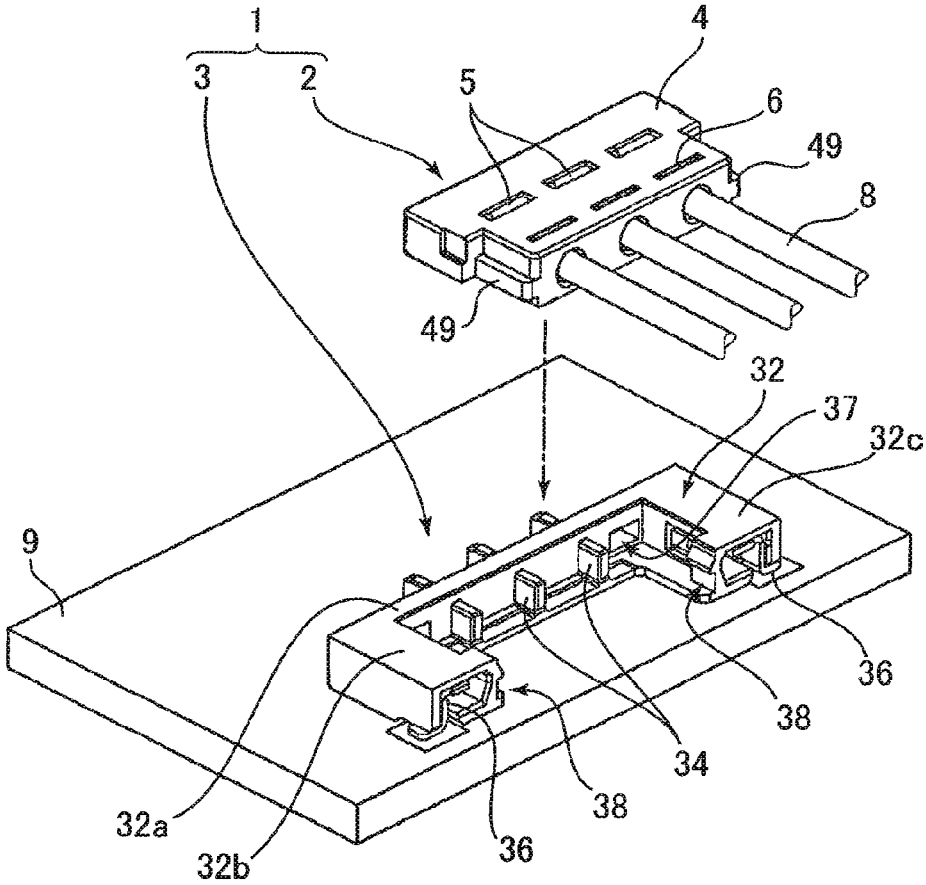
FIG. 1A is an exploded perspective view of a connector according to the Present Disclosure.
Figure 1B:
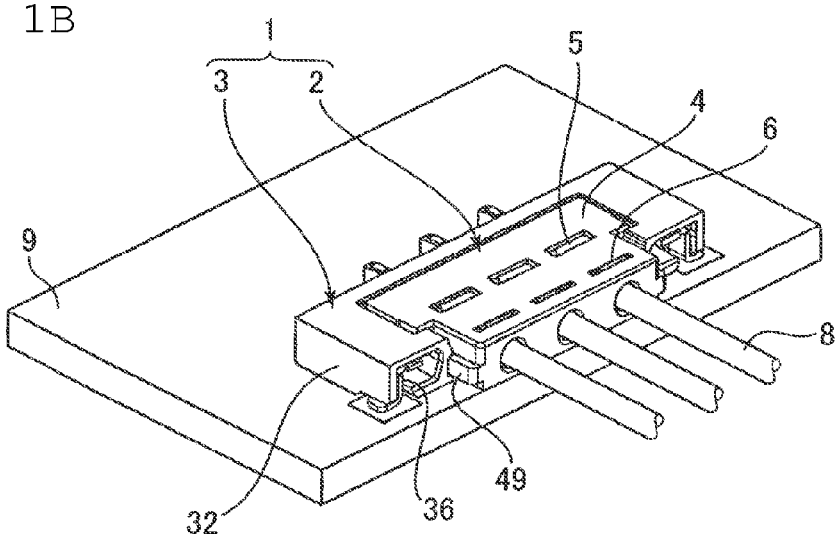
FIG. 1B is a perspective view of the connector of FIG. 1A.

Referring to FIGS. 1A-1B, the connector 1 is provided with a female connector 3 and the male connector 2 that should be inserted into this female connector 3. FIG. 1A shows the state before the male connector 2 is inserted into the female connector 3, and FIG. 1B shows the state after the male connector 2 was inserted into the female connector 3. An arrow with an alternate long and short dash line in FIG. 1A shows the insertion direction of the male connector 2.

The female connector 3 is provided with a case 32 formed by using an insulating resin material, a terminal 34 made of a conductive metal material and a support metal fitting 36 formed of a bent metal plate and is mounted on a circuit board 9. The case 32 has three sides 32*a*-32*c* formed substantially in a C-shape as a whole, and the terminal 34 is mounted on the middle side 32*a* and the support metal fittings 36 on both lateral sides 32*b* and 32*c*. The male connector 2 is fitted into the substantially C-shaped part formed by the three sides 32*a*-32*c*. The terminal 34 is formed in a plate-like shape and supported by the middle side 32*a* in an upstanding condition. The support metal fittings 36 are fitted into both lateral sided 32*b*, 32*c* and then fixed on the circuit board 9 by soldering or with adhesive. Latching grooves 37 and 38 are respectively formed on the three sides 32*a*-32*c* for latching the male connector 2.

Figure 2:
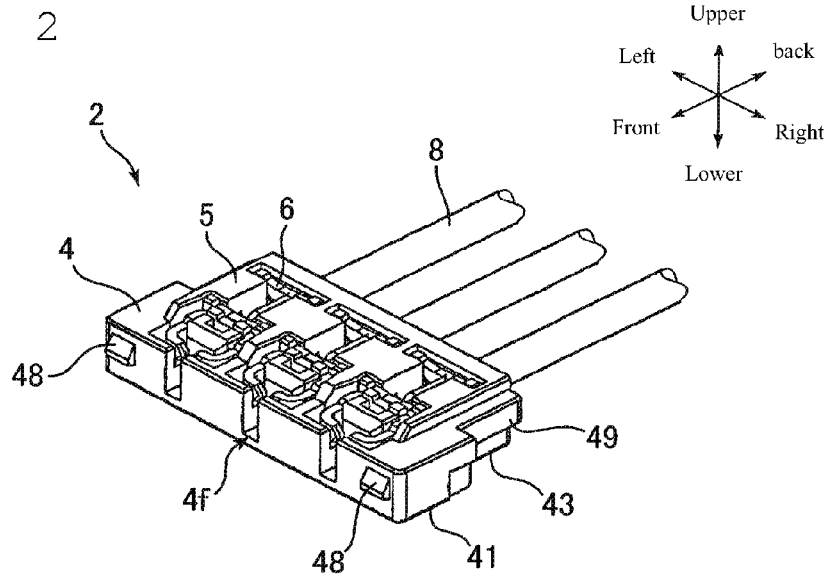
FIG. 2 is a perspective view of a male connector contained in the connector of FIG. 1A.
Figure 3A:
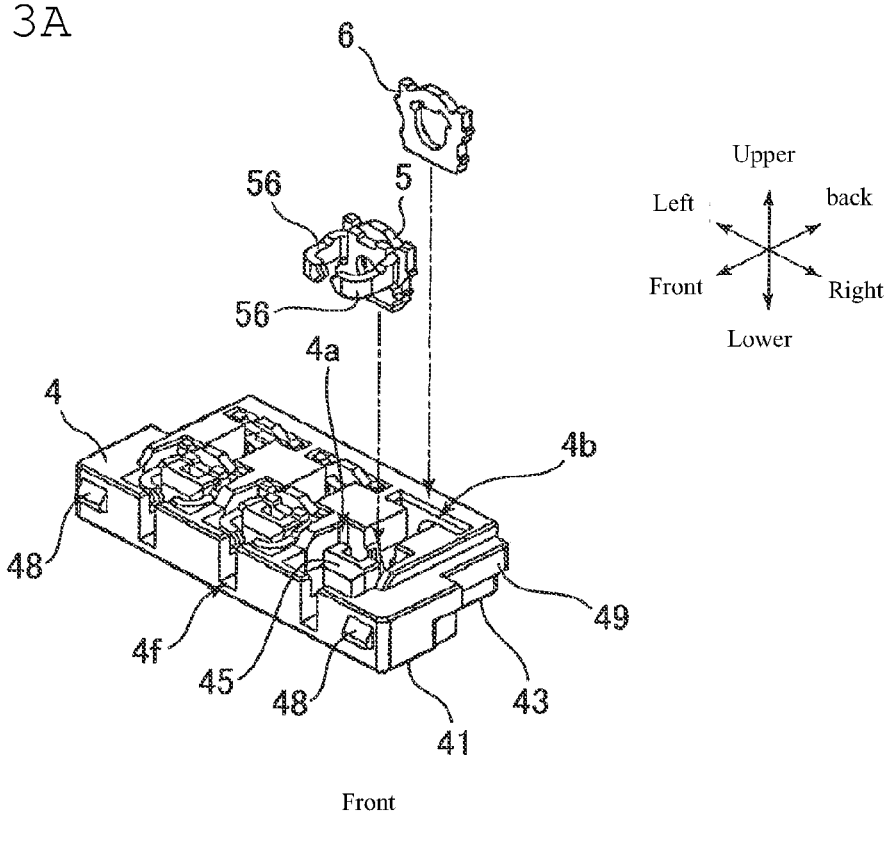
FIG. 3A is a perspective view of the male connector of FIG. 2.
Figure 3B:
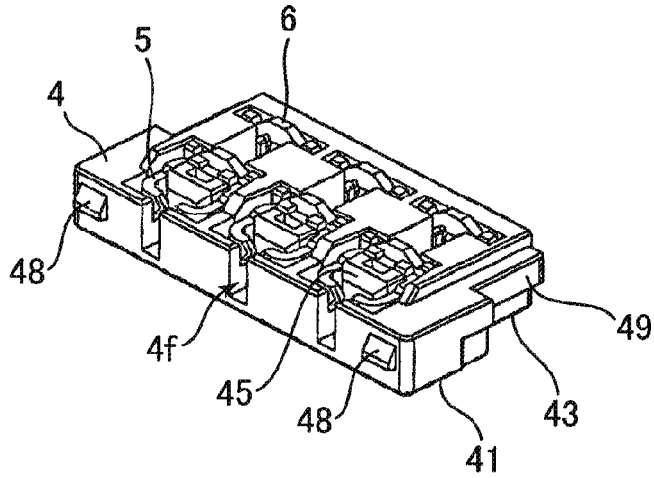
FIG. 3B is a perspective view of the male connector of FIG. 2.
Figure 4:
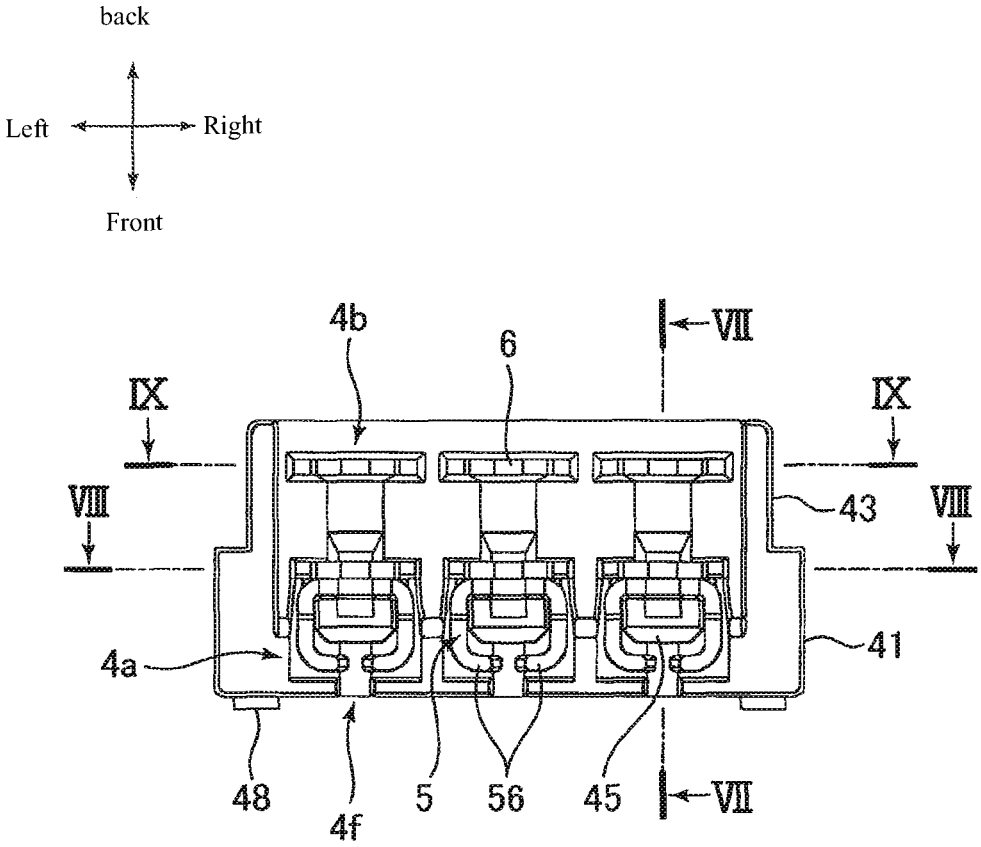
FIG. 4 is a top view of the male connector of FIG. 2.

As shown in FIGS. 2-4, the male connector 2 is provided with a case 4 formed by using an insulating resin material, a terminal 5 made of a conductive metal material and a metal fitting 6 made of a metal material, and a cable 8 is to be attached to this male connector 2. On the case 4, a support groove 4*a* for containing the terminal 5, a support groove 4*b* for containing the metal fitting 6 and an insertion hole 4*d* into which the cable 8 should be inserted (see FIG. 7) are formed. FIG. 3A shows the state before the terminal 5 and the metal fitting 6 are placed in the support grooves 4*a* and 4*b*, respectively, and FIGS. 3B 4 show the state after the terminal 5 and the metal fitting 6 were placed in the support grooves 4*a* and 4*b*, respectively. An arrow with an alternate long and short dash line in FIG. 3A shows the containing direction of the terminal 5 and the metal fitting 6. As used herein, the containing direction of the terminal 5 and the metal fitting 6, i.e., the depth direction of the support grooves 4*a* and 4*b* are defined as the downward direction and the insertion direction of the cable 8 as the forward direction. The insertion direction of the male connector 2 as shown in FIG. 1A above corresponds to the upward direction in FIG. 2 and thereafter.

The case 4 is formed in a flat box-like shape, which is shorter in the vertical direction, and a first half 41 is slightly wider in the horizontal direction than a second half 43. On the front face of the first half 41, latching blocks 48 protruding forward are formed. These latching blocks 48 are fitted into latching grooves 37 formed on the female connector 3 (see FIG. 1A). Moreover, on both lateral sides of the second half 43, latching blocks 49 protruding outward in the horizontal direction are formed. These latching blocks 49 are fitted into latching grooves 38 formed on the female connector 3 (see FIG. 1A).

In the first half 41 of the case 4, the support grooves 4*a* for containing the terminals 5 are formed in a series in the horizontal direction. The support groove 4*a* is formed in a rectangular frame-like shape corresponding to the shape of the terminal 5, and a stopper 45 is provided at the center thereof. The terminal 5 is sandwiched between the rear wall of the support groove 4*a* and the stopper 45, and thereby displacement is restricted in the front-back direction. The distance between the rear wall of the support groove 4*a* and the stopper 45 may be the same as the thickness of the terminal 5 or slightly larger than that. Moreover, the terminal 5 is pressed in between both side walls of the support groove 4*a* in the horizontal direction, and thereby both displacement in the horizontal direction and displacement in the vertical direction are restricted.

A pair of contact parts 56 provided for the terminal 5 is disposed at a space in the support groove 4*a* other than the space between the rear wall of the support groove 4*a* and the stopper 45. The pair of contact parts 56 is curved in such a direction that both contact parts come closer to each other and the tip ends thereof face each other in front of the stopper 45. Moreover, a slit 4*f* connecting to the support groove 4*a* is formed on the front end of the case 4. The terminal 34 provided on the female connector 3 is inserted into the slit 4*f* formed on the front end of the case 4 and is sandwiched between the pair of contact parts 56 disposed inside the support groove 4*a*.

In the second half 43 of the case 4, the support grooves 4*b* for containing the metal fitting 6 are formed in a series in the horizontal direction. The support groove 4*b* is formed linearly extending in the horizontal direction corresponding to the shape of the metal fitting 6. The metal fitting 6 is sandwiched between the front wall and the rear wall of the support groove 4*b*, and thereby displacement is restricted in the front-back direction. The distance between the front wall and the rear wall of the support groove 4*b* may be the same as the thickness of the metal fitting 6 or slightly larger than that. Moreover, the metal fitting 6 is pressed in between both side walls of the support groove 4*b* in the horizontal direction, and thereby both displacement in the horizontal direction and displacement in the vertical direction are restricted.

Figure 7A:
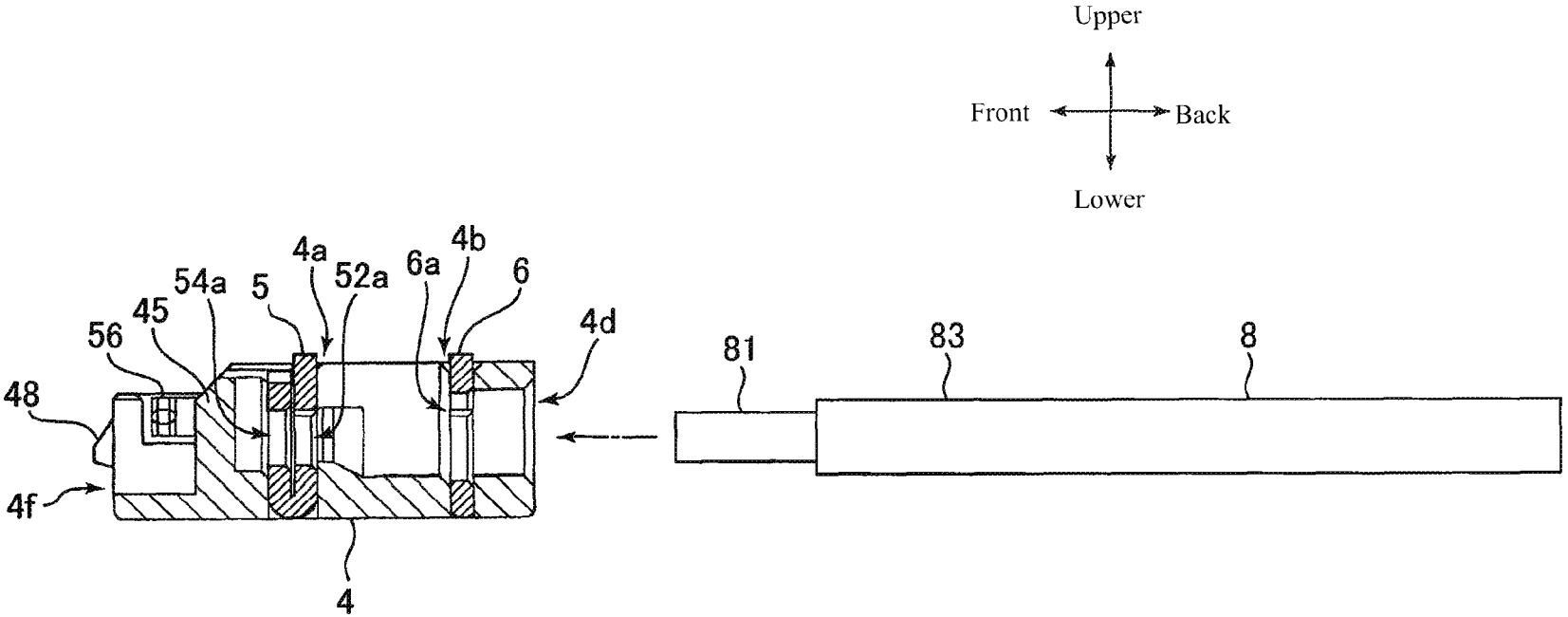
FIG. 7A is a sectional view of the male connector of FIG. 2.

The case 4 has an opening at the rear end face thereof, and an insertion hole 4*d* extending in the forward direction is formed (see FIG. 7A). The cable 8 is inserted into the insertion hole 4*d* from the rear of the case 4 to the front thereof. The insertion hole 4*d* is connected to the support groove 4*a* in which the terminal 5 is contained and the support groove 4*b* in which the metal fitting 6 is contained. In other words, internal spaces of the support grooves 4*a* and 4*b* and the insertion hole 4*d* are connected to each other within the case 4. The insertion hole 4*d* extends to the stopper 45, and the cable 8 inserted into the insertion hole 4*d* reaches the stopper 45. No upper wall is provided for the insertion hole 4*d* between the stopper 45 and the support groove 4*a* and between the support groove 4*a* and the support groove 4*b*.

Figure 5A:
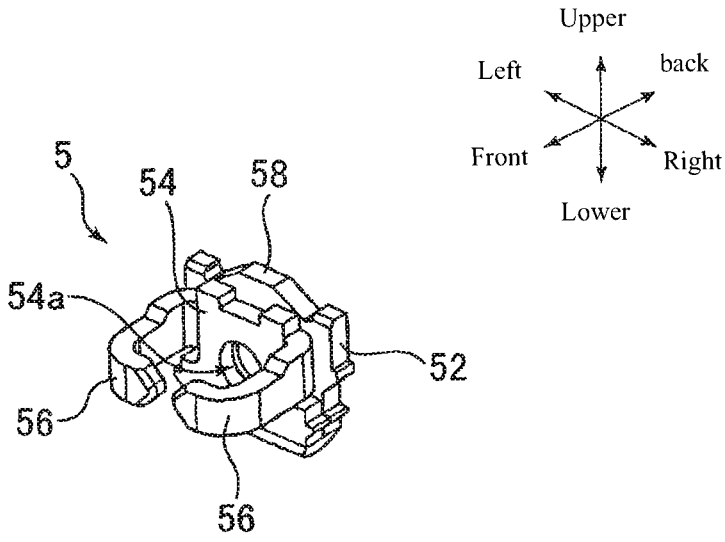
FIG. 5A is a perspective view of a terminal contained in the male connector of FIG. 2.
Figure 5B:
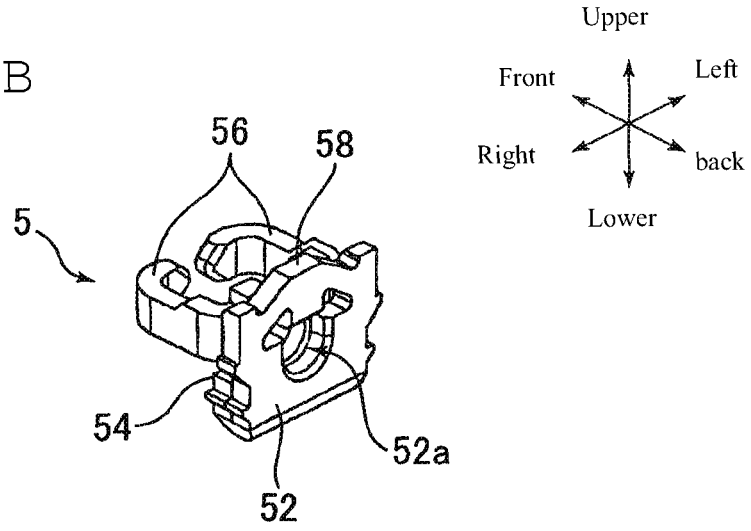
FIG. 5B is a perspective view of the terminal of FIG. 5A.

As shown in FIGS. 5A and 5B, the terminal 5 is formed of metal plates that were punched out or etched and then bent. The terminal 5 has a first plate part 52 and a second plate part 54, and those plate parts are bent such that they overlap each other. The first plate part 52 and the second plate part 54 have through-holes 52*a* and 54*a* respectively that penetrate in the direction of the thickness of the plates. The first plate part 52 has a compression part 58 that is protruded in the direction away from the through-hole 52*a*. The second plate part 54 has a pair of contact parts 56 that are bent in the forward direction.

Figure 8A:
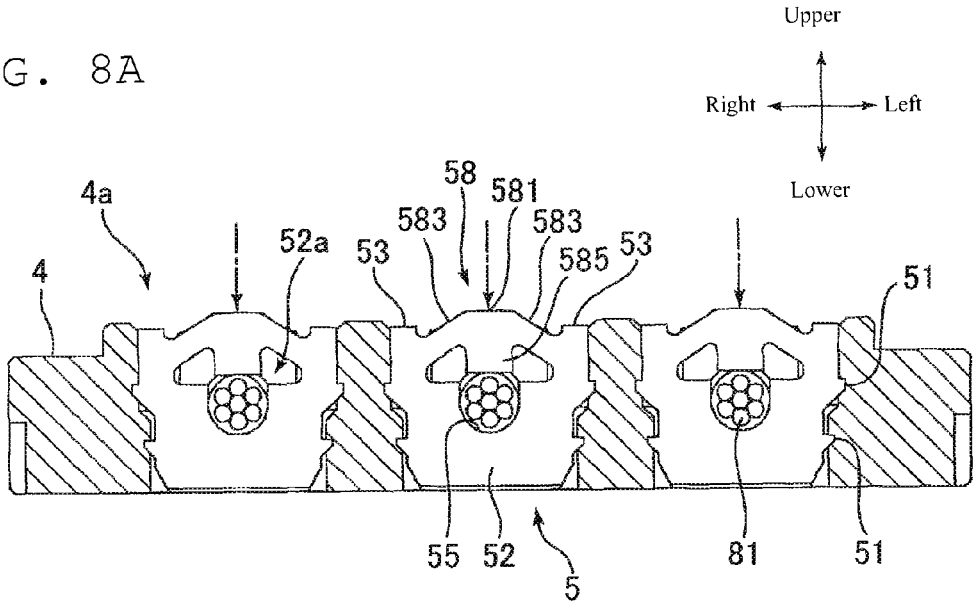
FIG. 8A is a sectional view of the male connector of FIG. 2.

The compression part 58 provided for the first plate part 52 protrudes upward like a mountain while it is contained in the support groove 4*a* of the case 4 (see FIG. 8A). The compression part 58 is constituted of a top edge 581 that is provided at the center in the horizontal direction and sticks out at the uppermost portion, a pair of beam parts 583 extending from the lateral sides toward the top edge 581 and an incisor tooth part 585 formed in such a manner that the edge of the through-hole 52*a* protrudes downward at the lower portion of the top edge 581, and they are connected to each other integrally. The pair of beam parts 583 inclines such that the center in the horizontal direction goes away from the through-hole 52*a* more than the lateral sides do. At a portion facing the incisor tooth part 585, a receiving part 55 is formed on the edge of the through-hole 52*a* in such a manner as to curve in a semicircular shape along the outward form of the cable 8, which is to be inserted into the through-hole 52*a*. Since metal wires 81 exposed at the tip end of the cable 8 is inserted into the through-hole 52*a* of the terminal 5, the curvature of the receiving part 55 is relatively large.

On both sides of the compression part 58 in the horizontal direction, protrusions 53 protruding upward are provided. These protrusions 53 are compressed mechanically or by human hand, for example, downward at the time of placing the terminal 5 in the support groove 4*a*. After the terminal 5 was placed in the support groove 4*a*, the upper ends of the protrusions 53 are disposed substantially at the same height of the upper end of the support groove 4*a*. Moreover, after the terminal 5 was placed in the support groove 4*a*, part of the top edge 581 of the compression part 58 is located outside the support groove 4*a*. The support groove 4*a* penetrates downward, and the terminal 5 is pressed in between the side walls of the support groove 4*a* in the horizontal direction. Lateral tooth parts 51 each having a saw tooth shape are formed on both sides of the terminal 5 in the horizontal direction, and these lateral tooth parts 51 cut into the side walls of the support groove 4*a* in the horizontal direction. After the terminal 5 was placed in the support groove 4*a*, the lower end of the terminal 5 is located substantially at the same height as the lower end of the support groove 4*a*.

Figure 6A:
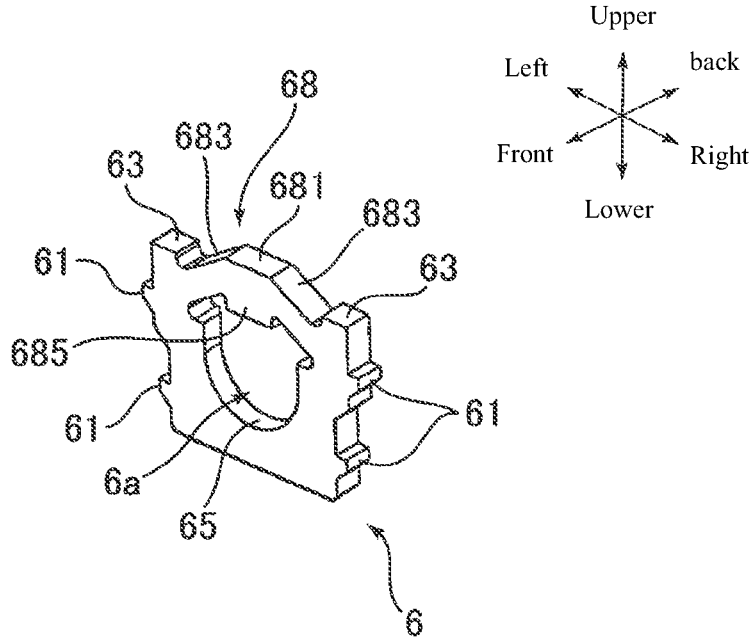
FIG. 6A is a perspective view of a metal fitting in the male connector of FIG. 2.
Figure 6B:
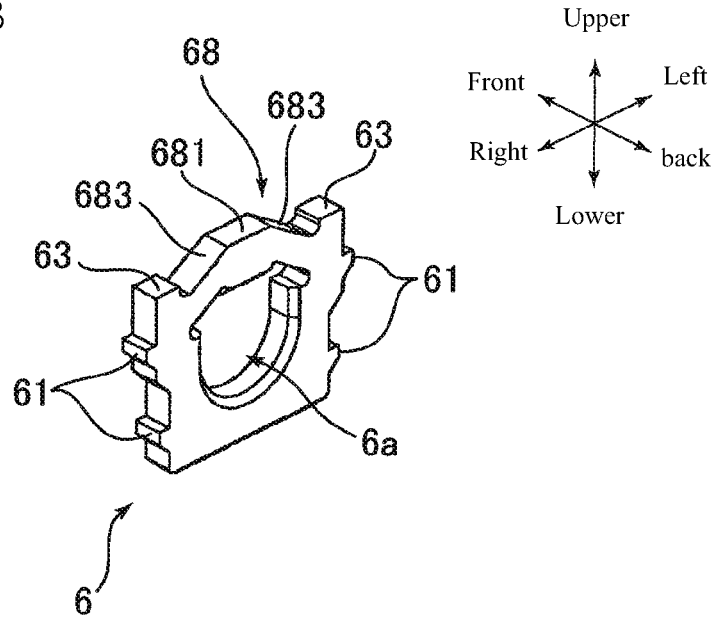
FIG. 6B is a perspective view of the metal fitting of FIG. 6A.

As shown in FIGS. 6A-6B, the metal fitting 6 is formed of a punched out or etched metal plate. The metal fitting 6 has a shape similar to that of the first plate part 52. In other words, the metal fitting 6 has a through-hole 6*a* that penetrates in the direction of the thickness of the plate and a compression part 68 protruding in the direction away from the through-hole 6*a*. The compression part 68 provided for the metal fitting 6 protrudes upward like a mountain while it is contained in the support groove 4*a* of the case 4 (see FIG. 9A). The compression part 68 is constituted of a top edge 681 that is provided at the center in the horizontal direction and sticks out at the uppermost portion, a pair of beam parts 683 extending from the lateral sides toward the top edge 681 and an incisor tooth part 685 formed in such a manner that the edge of the through-hole 6*a* protrudes downward at the lower portion of the top edge 681. The pair of beam parts 683 inclines such that the center in the horizontal direction goes away from the through-hole 6*a* more than the lateral sides do. At a portion facing the incisor tooth part 685, a receiving part 65 is formed on the edge of the through-hole 6*a* in such a manner as to curve in a semicircular shape along the outward form of the cable 8, which is to be inserted into the through-hole 6*a*. Since a section coated by an insulating outer coat 83 of the cable 8 is inserted into the through-hole 6*a* of the metal fitting 6, the curvature of the receiving part 65 is relatively large.

On both sides of the compression part 68 in the horizontal direction, protrusions 63 protruding upward are provided. These protrusions 63 are compressed mechanically or manually, for example, downward at the time of placing the metal fitting 6 in the support groove 4*b*. After the metal fitting 6 was placed in the support groove 4*b*, the upper ends of the protrusions 63 are disposed substantially at the same height of the upper end of the support groove 4*b*. Moreover, after the metal fitting 6 was placed in the support groove 4*b*, part of the top edge 681 of the compression part 68 is located outside the support groove 4*b*. The support groove 4*b* penetrates downward, and the metal fitting 6 is pressed in between the side walls of the support groove 4*b* in the horizontal direction. Lateral tooth parts 61 each having a saw tooth shape are formed on both sides of the metal fitting 6 in the horizontal direction, and these lateral tooth parts 61 cut into the side walls of the support groove 4*b* in the horizontal direction. After the metal fitting 6 was placed in the support groove 4*a*, the lower end of the metal fitting 6 is located substantially at the same height as the lower end of the support groove 4*b*.

FIG. 7A shows the state after the terminal 5 and the fitting metal 6 were placed in the support grooves 4*a* and 4*b* respectively as well as the state before the cable 8 is inserted into the terminal 5 and the fitting metal 6. In the case 4 in which the terminal 5 and the fitting metal 6 were placed in the support grooves 4*a* and 4*b* respectively, the insertion hole 4*d*, the through-holes 52*a* and 54*a* of the terminal 5 placed in the support groove 4*a* and the through-hole 6*a* of the metal fitting 6 placed in the support groove 4*b* are linearly continuous, and thereby the insertion path of the cable is formed. An arrow with an alternate long and short dash line in FIG. 7A shows the insertion direction of the cable 8.

Figure 7B:
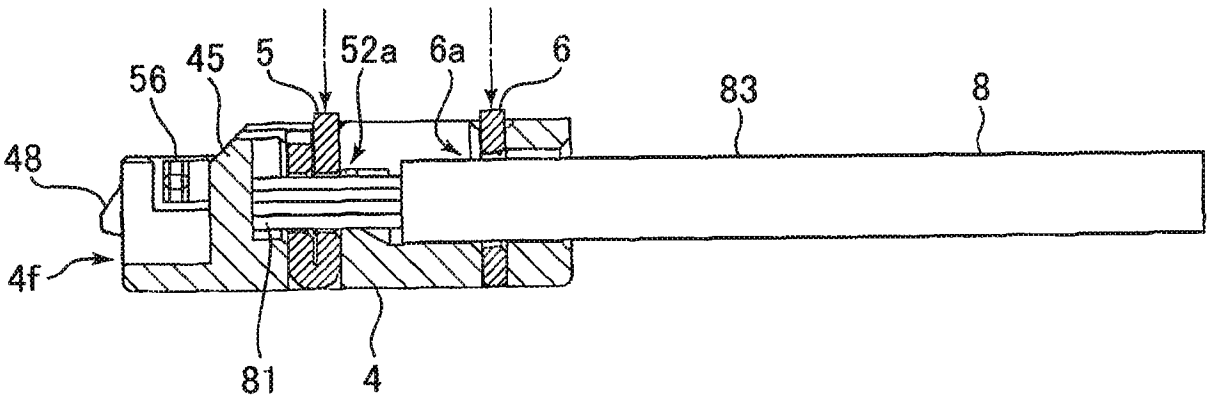
FIG. 7B is a sectional view of the male connector of FIG. 2.

FIG. 7B shows the state after the cable 8 was inserted into the terminal 5 and metal fitting 6. The cable 8 inserted into the insertion hole 4*d* is inserted into the through-holes 52*a*, 54*a* of the terminal 5 placed in the support groove 4*a* and the through-hole 6*a* of the metal fitting 6 placed in the support groove 4*b*. More specifically, the metal wires 81 exposed at the tip end of the cable 8 is inserted into the through-holes 52*a*, 54*a* of the terminal 5 placed in the support groove 4*a*, and a portion of the cable 8 covered by the insulating outer coat 83 is inserted into the through-hole 6*a* of the metal fitting 6 placed in the support groove 4*b*. The cable 8 is inserted until the metal wires 81 reach the stopper 45 of the case 4. Since no upper wall is provided for the insertion hole 4*d* between the stopper 45 and the support groove 4*a* and between the support groove 4*a* and the support groove 4*b*, it is possible to confirm how far the cable 8 has been inserted from above the case 4. The cable 8 is crimped by compressing downward the terminal 5 and the metal fitting 6 that have been placed in the support grooves 4*a* and 4*b* respectively and into which the cable 8 has been inserted.

Figure 8B:
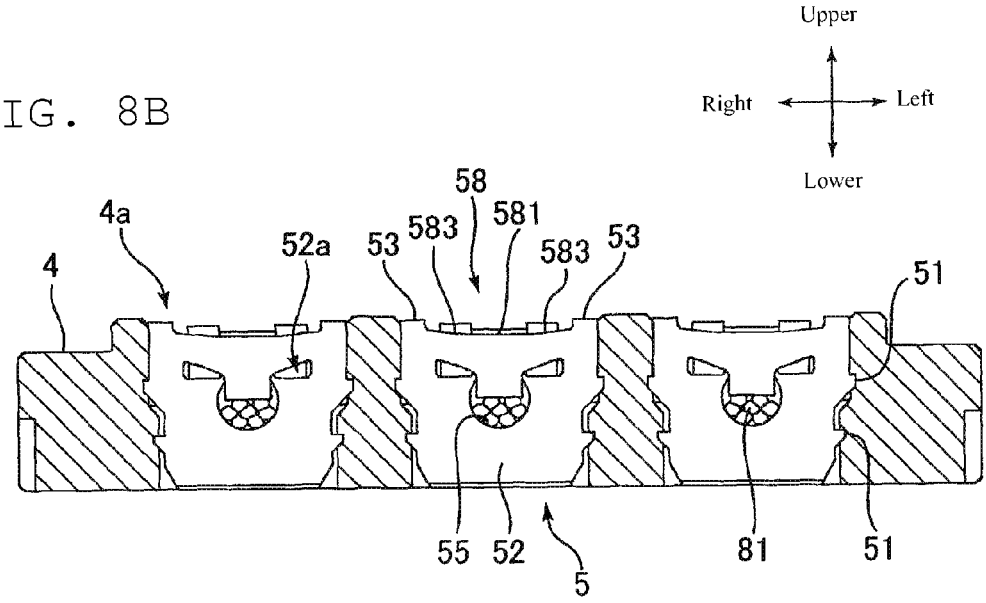
FIG. 8B is a sectional view of the male connector of FIG. 2.

FIG. 8A shows the state after the cable 8 was inserted into the terminal 5 and before the terminal 5 is compressed. FIG. 8B shows the state after the terminal 5 was compressed. The terminal 5 placed in the support groove 4*a* and into which the cable 8 has been inserted plastically deforms such that the size of the through-hole 52*a* decreases when the compression part 58 is compressed downward, thereby crimping the metal wires 81 of the cable 8. The terminal 5 is formed such that the compression part 58 mainly deforms downward, and the size of the through-hole 52 decreases when the compression part 58 deforms downward, whereby the edge of the through-hole 52*a* is brought into contact with the metal wires 81 of the cable 8 under pressure. Compression may be carried out mechanically or by human hand, for example. At the time of compression, a jig may be used, for example, on the lower end of the terminal 5 exposed on the lower side of the support groove 4*a*. As a result, compressive force from above and counterforce from bottom are applied to the terminal 5 such that it is sandwiched vertically.

The compression part 58 protruding upward like a mountain before compression is pushed into the support groove 4*a* and deformed into a flat shape or a concave shape (i.e., a shape dented downward) when the top edge 581 at the center is compressed downward. The direction of inclination is reversed in the pair of beam parts 583 provided on both sides of the top edge 581 in the horizontal direction when the top edge 581 at the center is compressed downward. In other words, the direction of the inclination changes such that the pair of beam parts 583 comes closer to the through-hole 52*a* at the center in the horizontal direction than at the lateral sides. After the compression part 58 was deformed, the metal wires 81 of the cable 8 are sandwiched between the incisor 585 formed on the lower side of the top edge 581 and the receiving part 55. As a result, the terminal 5 is fixed on the metal wires 81 of the cable 8. In the present embodiment, the lower end of the incisor 585 is flat, yet the shape of the incisor 585 is not limited to this example; it may be protruded downward or dented upward. The shapes of the incisor part 585 and the receiving part 55 are properly adjusted so that the metal wires 81 of the cable 8 can be placed in the space formed between the incisor part 585 and the receiving part 55.

Figure 9A:
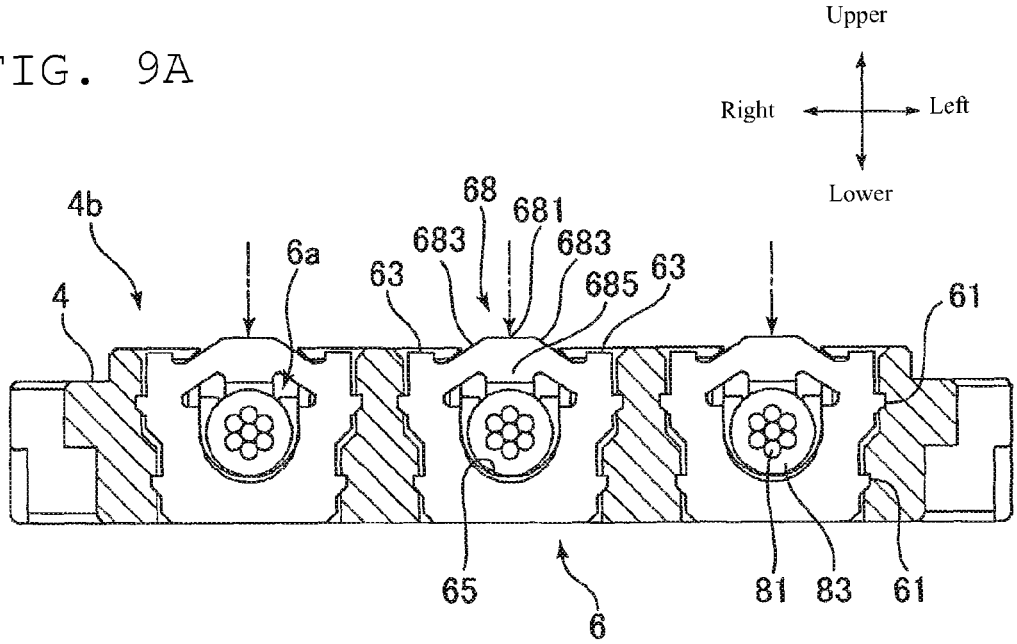
FIG. 9A is a sectional view of the male connector of FIG. 2.
Figure 9B:
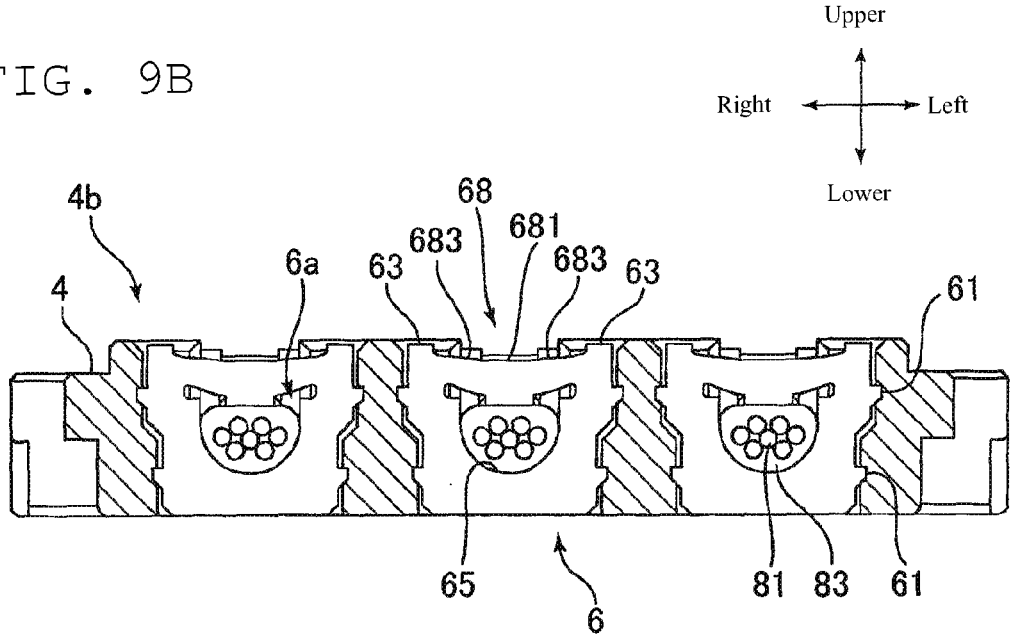
FIG. 9B is a sectional view of the male connector of FIG. 2.

FIG. 9A shows the state after the cable 8 was inserted into the metal fitting 6 and before the metal fitting 6 is compressed. FIG. 9B shows the state after the metal fitting 6 was compressed. The metal fitting 6 also deforms in a manner similar to the terminal 5. In other words, the metal fitting 6 placed in the support groove 4*b* and into which the cable 8 has been inserted plastically deforms such that the size of the through-hole 6*a* decreases when the compression part 68 is compressed downward, thereby crimping the outer coat 83 of the cable 8. The metal fitting 6 is formed such that the compression part 68 mainly deforms downward, and the size of the through-hole 6*a* decreases when the compression part 68 deforms downward, whereby the edge of the through-hole 6*a* is brought into contact with the outer coat 83 of the cable 8 under pressure. Compression may be carried out mechanically or manually, for example. At the time of compression, a jig may be used, for example, on the lower end of the metal fitting 6 exposed on the lower side of the support groove 4*b*. As a result, compressive force from above and counterforce from bottom are applied to the metal fitting 6 such that it is sandwiched.

The compression part 68 protruding upward like a mountain before compression is pushed into the support groove 4*b* and deformed into a flat shape or a concave shape (i.e., a shape dented downward) when the top edge 681 at the center is compressed downward. The direction of inclination is reversed in the pair of beam parts 683 provided on both sides of the top edge 681 in the horizontal direction when the top edge 681 at the center is compressed downward. In other words, the direction of the inclination changes such that the pair of beam parts 683 comes closer to the through-hole 6*a* at the center in the horizontal direction than at the lateral sides. After the compression part 68 was deformed, the cable 8 is sandwiched between the incisor 685 formed on the lower side of the top edge 681 and the receiving part 66. As a result, the metal fitting 6 is fixed on the outer coat 83 of the cable 8. In the present embodiment, the lower end of the incisor 685 is flat, yet the shape of the incisor 685 is not particularly limited to this example; it may be protruded downward or dented upward. The shapes of the incisor part 685 and the receiving part 66 are properly adjusted so that the outer coat 83 of the cable 8 can be placed in the space formed between the incisor part 685 and the receiving part 66.

Figure 10:
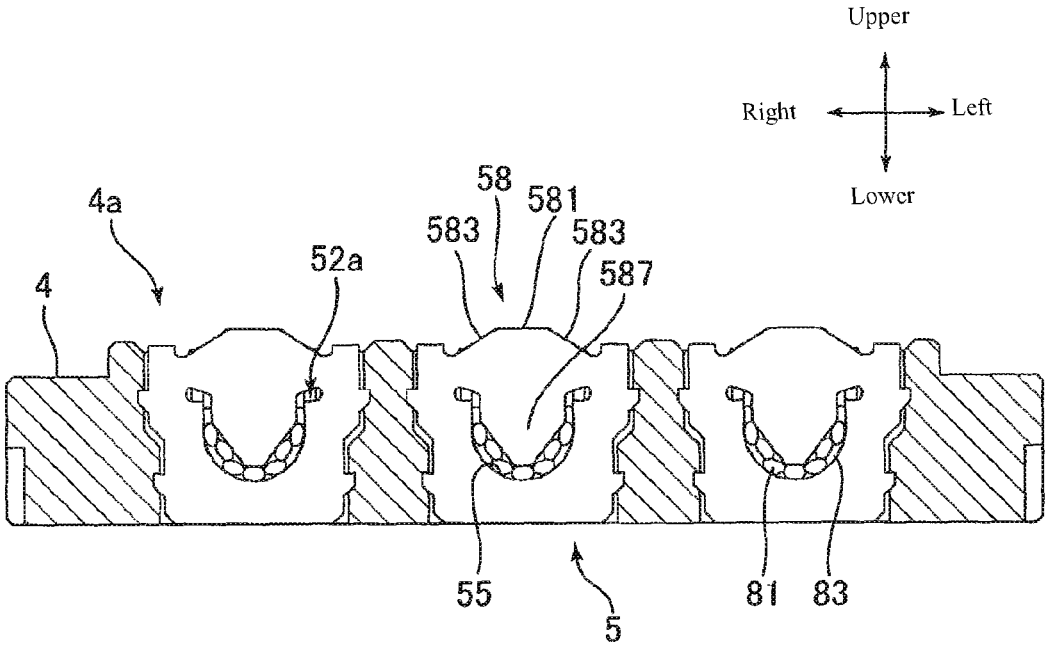
FIG. 10 is a sectional view of a male connector according to the Present Disclosure.

FIG. 10 is a sectional view of another male connector Like reference numerals are used for similar parts in the above-mentioned embodiment, whereby detailed explanation will be omitted. In this variation, an incisor tooth part 587 provided for the terminal 5 protrudes downward at an acute angle. On the other hand, in the cable 8 inserted into the through-hole 52*a* of the terminal 5, the metal wires 81 are not exposed to the outside; the metal wires 81 are covered by the outer coat 83. When the compression part 58 is compressed downward, the incisor tooth part 587 protruding at an acute angle cuts the outer coat 83 of the cable 8 and comes into contact with the metal wires 83 inside. Accordingly, the terminal 5 is electrically connected to the metal wires 83 inside without exposing the metal wires 83 inside in advance.

Figure 11:
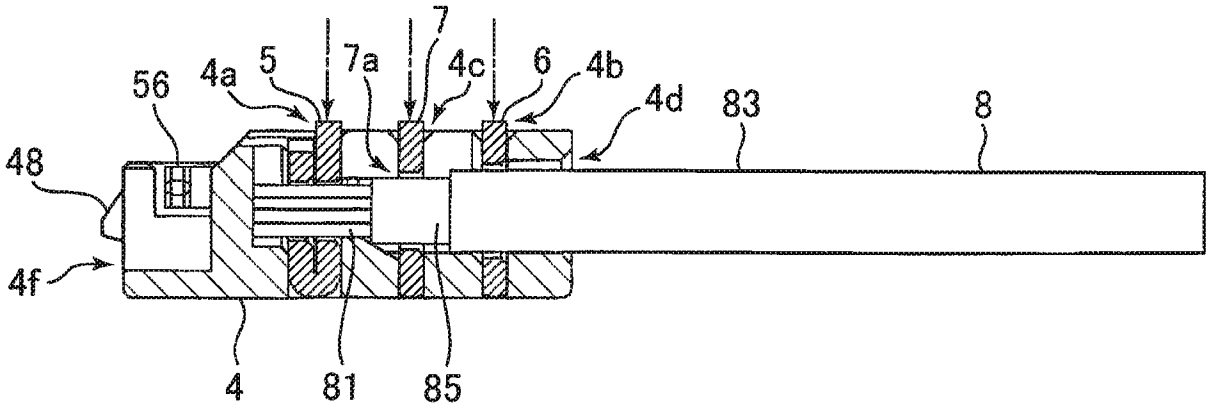
FIG. 11 is a sectional view of a male connector according to the Present Disclosure.

FIG. 11 is a sectional view of a male connector according to a second variation Like reference numerals are used for similar parts in the above-mentioned embodiment, whereby detailed explanation will be omitted. In this variation, the case 2 has a support groove 4*c* for containing a terminal 7 having the same shape as the metal fitting 6, the support groove 4*c* formed between the support groove 4*a* for containing the terminal 5 and the support groove 4*b* for containing the metal fitting 6. This support groove 4*c* is also continuous to the insertion hole 4*d* of the cable 8. The cable 8 is a coaxial cable and has an outer conductor for grounding 85 exposed between the metal wires 81, which is exposed at the tip end, and the insulating outer coat 83. A portion of the cable 8 inserted into the insertion hole 4*d* where the outer conductor 85 is exposed is inserted into a through-hole 7*a*. When the terminal 7 is compressed downward, the portion plastically deforms, and thereby the outer conductor 85 of the cable 8 is crimped. Accordingly, the terminal 7 is used as a grounding terminal.

Although the support grooves 4*a*, 4*b* and 4*c* formed in the case 4 are respectively inserted into the terminal 5, the metal fitting 6 and the terminal 7 in the described embodiments, the Present Disclosure is not limited to these embodiments; the case 4 may directly be formed around the terminal 5 and the metal fitting 6 (i.e., so-called overmolding). Furthermore, although the support grooves 4*a* and 4*b* formed in the case 4 penetrates downward in these embodiments, the Present Disclosure is not limited to these embodiments; the support grooves 4*a* and 4*b* may each have the bottom. The terminal 5 and the metal fitting 6 can be contained and compressed as far as the support grooves 4*a* and 4*b* are open at least in one direction.

Additionally, although the support grooves 4*a* and 4*b* formed in the case 4 each has the depth large enough for the terminal 5 and the metal fitting 6 to be fully contained, the Present Disclosure is not particularly limited to these embodiments; the support grooves 4*a* and 4*b* may each have the depth containing only part of the terminal 5 and the metal fitting 6. Furthermore, although the through-holes 52*a*, 54*a* and 6*a* formed in the terminal 5 and the metal fitting 6 respectively each have a completely closed shape in these embodiments, the Present Disclosure is not particularly limited to these embodiments; it may not be completely closed as far as the shape is such that the cable 8 can be inserted and fixed.

Additionally, although part of the compression part 58 is disposed outside the support groove 4*a* when the terminal 5 is placed in the support groove 4*a* in these embodiments, the Present Disclosure is not particularly limited to these embodiments; the compression part 58 may be placed inside the support groove 4*a* in its entirety. In this case, the compression part 58 is compressed by a jig or the like. This is also true for the metal fitting 6. Furthermore, although the compression part 58 is disposed inside the support groove 4*a* in its entirety after the compression part 58 was compressed in these embodiments, the Present Disclosure is not particularly limited to these embodiments; part of the compression part 58 may be placed outside the support groove 4*a* even after the compression part 58 was compressed. This is also true for the metal fitting 6. Finally, although in the pair of beam parts 583 of the compression part 58, the direction of inclination is reversed such that the center in the horizontal direction comes closer to the through-hole 6*a* than the lateral sides do after the compression part 58 was compressed in these embodiments, the Present Disclosure is not particularly limited to these embodiments; the direction of inclination may not be reversed. This is also true for the metal fitting 6.

While a preferred embodiment of the Present Disclosure is shown and described, it is envisioned that those skilled in the art may devise various modifications without departing from the spirit and scope of the foregoing Description and the appended Claims.

What is claimed is:

1. A connector, the connector comprising:

a metal fitting in which a through-hole is formed; and a case, the case comprising:

a support groove for containing the metal fitting in such a manner as to restrict the displacement of the metal fitting at least in the extending direction of the through-hole, and an insertion hole for inserting a cable, the insertion hole being continuous to the support groove in such a manner that the cable inserted into the insertion hole is inserted into the through-hole of the metal fitting contained in the support groove;

wherein the metal fitting contained in the support groove plastically deforms such that the size of the through-hole decreases when it is compressed in the depth direction of the support groove.

2. The connector according to claim 1, wherein the metal fitting comprises a compression part, the compression part protruding in the direction away from the through-hole, which is the direction opposite to the depth direction of the support groove.

3. The connector according to claim 2, wherein the compression part comprises an incision tooth part, the incision tooth part formed such that the edge of the through-hole protrudes in the depth direction of the support groove to come into contact with the cable.

4. The connector according to claim 3, wherein a receiving part is formed at a portion facing the incisor tooth part on the edge of the through-hole, the receiving part having a curved shape along the outward form of the cable.

5. The connector according to claim 4, wherein the metal fitting comprises protrusions on both sides of the compression part in the width direction of the support groove, the protrusions protruding in the direction opposite to the depth direction of the support groove.

6. The connector according to claim 5, wherein the metal fitting is a terminal composed of bent metal plates and comprises a first plate part comprising the compression part and on which the through-hole is formed and a second plate part comprising a contact part for contacting the other terminal and on which the through-hole is formed, wherein the first plate part and the second plate part overlaps each other in such a manner that the through-holes become continuous.

7. The connector according to claim 1, wherein the metal filling is a metal fitting that comes into contact with the insulating outer coat of the cable.

8. The connector according to claim 1, wherein the compression part comprises an incision tooth part formed in such a manner that the edge of the through-hole protrudes in the depth direction of the support groove, wherein the incisor tooth part cuts the insulating outer coat of the cable and comes into contact with metal wires inside when the compression part is compressed in the depth direction of the support groove.

9. A connector, the connector comprising:

a first metal fitting on which a through-hole is formed;

a second metal fitting on which a through-hole is formed; and a case, the case comprising:

a first support groove for containing the first metal fitting in such a manner as to restrict the displacement of the first metal fitting at least in the extending direction of the through-hole;

a second support groove for containing the second metal fitting in such a manner as to restrict the displacement of the second metal fitting at least in the extending direction of the through-hole; and an insertion hole for inserting a cable, the insertion hole being continuous to the first support groove and the second support groove in such a manner that the cable inserted into the insertion hole is sequentially inserted into the through-hole of the first metal filling contained in the first support groove and the through-hole of the second metal filling contained in the second support groove;

wherein:

the first metal fitting contained in the first support groove plastically deforms such that the size of the through-hole decreases when it is compressed in the depth direction of the first support groove and comes into contact with the insulating outer coat of the cable; and the second metal fitting contained in the second support groove plastically deforms such that the size of the through-hole decreases when it is compressed in the depth direction of the second support groove and comes into contact with metal wires exposed at the tip end of the cable.

10. The connector according to claim 9, wherein:

the cable is a coaxial cable;

the connector further comprises a third metal fitting on which a through-hole is formed; and the case further comprises a third support groove for containing the third metal fitting, the third support groove being disposed between the first support groove and the second support groove, being continuous to the insertion hole and restricting the displacement of the third metal fitting at least in the extending direction of the through-hole;

wherein the third metal fitting contained in the third support groove plastically deforms such that the size of the through-hole decreases when it is compressed in the depth direction of the third support groove and comes into contact with an outer conductor exposed between metal wires exposed at the tip end of the coaxial cable and the insulating outer coat.

* * * * *